United States Patent [19]

Hill

[11] 4,319,301

[45] Mar. 9, 1982

[54] CIRCUITS FOR ELECTROMAGNET ENERGIZATION CONTROL

[75] Inventor: William F. Hill, Stafford, England

[73] Assignee: Lucas Industries, Limited, Birmingham, England

[21] Appl. No.: 187,882

[22] Filed: Sep. 17, 1980

[30] Foreign Application Priority Data

Sep. 22, 1979 [GB] United Kingdom ..... 32951/79

[51] Int. Cl.[3] ..... H01H 47/32

[52] U.S. Cl. ..... 361/152; 361/154

[58] Field of Search ..... 361/139, 143, 152, 154, 361/159, 160, 194

[56] References Cited

U.S. PATENT DOCUMENTS 2,951,186 8/1960 Dickinson ..... 361/159
3,149,244 9/1964 Barnes et al. ..... 361/152 X
3,183,412 5/1965 Arends ..... 361/159
4,142,684 3/1979 Schweitzer ..... 361/152 X

FOREIGN PATENT DOCUMENTS 449741 4/1968 Switzerland ..... 361/152

*Primary Examiner*—Harry E. Moose, Jr.
*Attorney, Agent, or Firm*—Ladas & Parry

[57] ABSTRACT

An electromagnet control circuit includes a first switching transistor which is connected in series with the electromagnet across a low voltage supply. A second switching transistor is connected to provide a high voltage supply to the electromagnet at switch-on. An inductor is connected by transistors to the low voltage supply and is supplied with current while the first switching transistor is on. At switch-off a diode interconnecting the electromagnet 10 and the inductor allows the inductor current to be diverted through the electromagnet to provide rapid flux decay in the latter.

4 Claims, 3 Drawing Figures

CIRCUITS FOR ELECTROMAGNET ENERGIZATION CONTROL

This invention relates to a circuit for the control of the energisation of an electromagnet and has an object to provide a convenient form of circuit in which both rapid switch-on and rapid drop-out can be achieved, even where the electromagnet has a non-laminated core so that rapid flux changes cause eddy currents.

Previously known circuits for achieving rapid switch-on and drop-out have involved the use either of a large number of high voltage switches connecting the electromagnet between a high voltage supply and a return conductor, the switches acting to reverse the voltage across the coil when drop-out is required, or a dual rail high voltage supply, for enabling rapid drop-out to be achieved.

A circuit in accordance with the invention comprises a first switching element connecting the electromagnet between a relatively low voltage supply and a return rail, a second switching element connecting the electromagnet to a relatively high voltage supply for providing a high voltage across the electromagnet at switch-on, an inductor, means connecting the inductor to the low voltage supply so that current can flow therein, and diode means connecting the inductor to the electromagnet whereby when said first and second switch means are turned off, the current flowing in the inductor is diverted through the electrogmagnet so as to oppose the current previously flowing in the latter.

An example of the invention is shown in the accompanying drawings in which.

Figure 1:
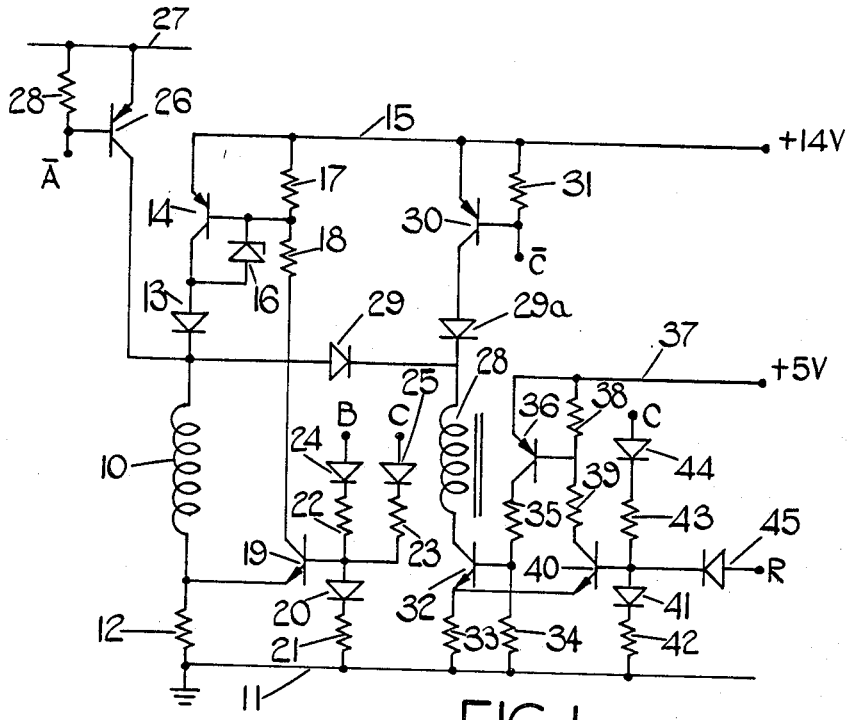
FIG. 1 is a circuit diagram of the control circuit.

The electromagnet 10 is connected at one end to an earth return 11 by a resistor 12, and at the other end to the cathode of a diode 13 the anode of which is connected by a first switching element in the form of a pnp transistor 14 to a +14 V supply rail 15. The emitter of the transistor 14 is connected to the rail 15 and its collector is connected to the anode of the diode 13. A zener diode 16 has its cathode connected to the base of the transistor 14 and its anode connected to the collector of the transistor 14.

The transistor 14 also has its base connected to the junction of two resistors 17, 18 which are connected in series between the rail 15 and the collector of an npn drive transistor 19, the emitter of which is connected to the junction of the resistor 12 and the electromagnet 10. The base of the transistor 19 is connected to the anode of a diode 20, the cathode of which is connected to earth by a resistor 21. The base of transistor 19 is also connected by two resistors 22, 23 to the cathodes of two diodes 24, 25 the anodes of which are connected to two control terminals B and C.

The cathode of diode 13 is also connected to the collector of a pnp transistor 26, the emitter of which is connected to a high voltage supply rail 27 (e.g. at 100 volts). A resistor 28 connects the base of the transistor 26 to the rail 27 and the base of the transistor 26 is also connected to a terminal $\overline{A}$.

An inductor 28 is connected at one end to the cathode of a diode 29 the anode of which is connected to the cathode of the diode 13. This same end of the inductor

28 is also connected to the cathode of a diode 29a the anode of which is connected to the collector of a pnp transistor 30, the emitter of which is connected to the +14 V rail 15. The base of the transistor 30 is connected by a resistor 31 to the rail 15 and is also connected to a terminal $\overline{C}$. The other end of the inductor 28 is connected to the collector of an npn transistor 32, the emitter of which is connected by a resistor 33 to earth. The base of the transistor 32 is connected to the junction of two resistors 34, 35 in series between the earth rail 11 and the collector of a pnp transistor 36. The emitter of transistor 36 is connected to a +5 V supply rail 37 and its base is connected to the junction of two resistors 38, 39 in series between the rail 37 and the collector of an npn transistor 40, the emitter of which is connected to the emitter of the transistor 33. The base of transistor 40 is connected to the anode of a diode 41, the cathode of which is connected by a resistor 42 to rail 11. The base of transistor 40 is connected by a resistor 43 to the cathode of a diode 44, the anode of which is connected to the terminal C. The base of the transistor 40 is also connected to the cathode of a diode 45, the anode of which is connected to a terminal R.

Figure 2:
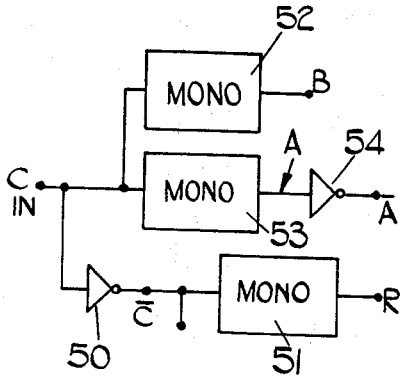
FIG. 2 is a block diagram of a circuit for producing control signals at various inputs of the circuit and FIG. 3 is a graph showing waveforms at various inputs to the circuit.

The circuit shown in FIG. 2 provides the $\overline{A}$, B, $\overline{C}$ and R inputs for the circuit of FIG. 1. The circuit shown includes three monostable circuits of the generally known kind which are d.c. triggered but include an R.C time constant circuit determining the length of time for which the output goes high following the input going high. As shown the $\overline{C}$ signal is derived by means of a simple logic inverter 50, the output of which drives one monostable circuit 51 to provide the R output. The C input also drives two further monostable circuits 52, 53 of which circuit 52 provides the B output and circuit 53 provides a A output which is inverted by a further logic inverter 54.

Figure 3:
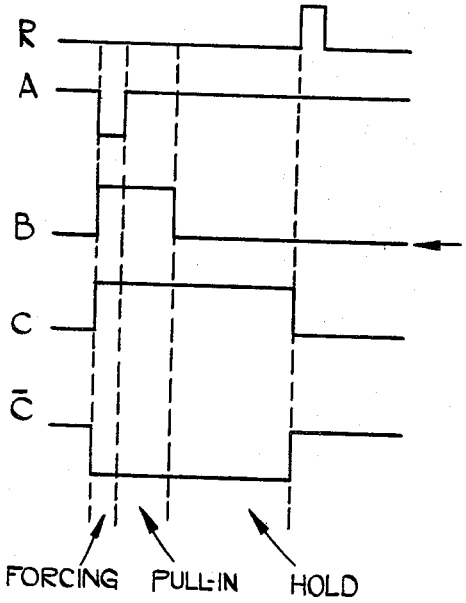

The outputs of the FIG. 2 circuit are as shown in FIG. 3, the C high input being of indeterminate duration. As shown, the commencement of the C high input causes the $\overline{A}$ output to go low for a short period and the B output to go high for a longer period. The R output goes high for a short period when the C input goes low again. The length of these periods are chosen to suit the electromagnet and the load it is driving.

When switch-on is required, a circuit (not shown) causes the signal at terminal C to go high. At this stage the $\overline{A}$ low signal turns on the transistor 26 causing current to build up very rapidly in the electromagnet 10 and (via the diode 29) in the inductor 28, the transistor 32 being biased on by the C signal via diode 44. The current in the electromagnet 10 is uncontrolled at this stage, but the current in the inductor 28, will cease to grow, when the current in the resistor 33 becomes sufficient to start biasing the transistor 40 off, the voltage at the base of transistor 40 being fixed at this stage.

During this "forcing" stage the current in the electromagnet 10 grows very rapidly indeed, for the duration of the $\overline{A}$ low signal, and, during this time grows to a level in excess of the so-called "pull-in" current required by the electromagnet to pull in its movable armature and any load mechanically connected thereto.

When the $\overline{A}$ low signal is discontinued, the B and C high signals and the $\overline{C}$ low signal continue. During this stage the current in the electromagnet 10 falls starting from a level normally below the "pull-in" current limit level determined by resistor 21, the transistors 14 and 19 being continuously saturated because the base of the latter is set to a predetermined voltage by current flowing through the resistor 21 from both the B and C terminals which predetermined voltage is higher than that across resistor 12. Meanwhile the current level in the inductor 28 now supplied via transistor 30 and diode 29*a* remains at the same fixed level it reached during the forcing stage. The B high signal continues for a time long enough for the armature of the electromagnet to complete its travel.

When the B signal goes low, the C high signal persists for as long as it is required to hold the armature in. During this period the current in resistor 21 is lower than previously because it is receiving current from terminal C only. Thus the voltage at the base of the transistor 19 falls and the current in transistor 14 falls causing an inductive surge voltage in winding 10 which is limited by feedback via zener diode 16, typically 100 volts, adequate to ensure rapid reduction of current without damaging the semi-conductors used. At this time the transistor 30 is in saturation and hence diode 29 is reverse biased.

Finally, when drop-out is required, the C signal goes low and the R signal goes high. The disappearance of the C high signal causes the transistors 14 and 30 to turn off. At the same time the transistor 32 is turned hard on by the R high signal. Because of the inductance of the electromagnet 10 and the inductor 28, both will now generate reverse voltages, so that the upper end of each as shown in FIG. 1 will take up a voltage which is negative relative to the rail 11. The inductor 28 is so designed, however, that at the relative current levels flowing before switch off, it will generate the more persistent reverse voltage and will therefore impose a reverse voltage on the electromagnet 10 thereby rapidly reversing the current in the electromagnet 10. The reverse voltage generated is limited by the action of the zener diode 16 as before and thereby causes transistor 14 to conduct and dissipate the energy remaining in the inductor 28. Thus, although the dissipation of the energy stored in the electromagnet and the inductor does take an appreciable time, the flux in the electromagnet is reduced rapidly, by the high surge voltage first permitted and then imposed, such rate of reduction being maintained after the current in the electromagnet has reversed, in order to overcome eddy currents.

I claim:

1. A circuit for the control of the energisation of an electromagnet, comprising a first switching element connecting the electromagnet between a relatively low voltage supply and a return rail, a second switching element connecting the electromagnet to a relatively high voltage supply for providing a high voltage across the electromagnet at switch-on, an inductor, means connecting the inductor to the low voltage supply so that current can flow therein, and diode means connecting the inductor to the electromagnet whereby when said first and second switch means are turned off, the current flowing in the inductor is diverted through the electromagnet so as to oppose the current previously flowing in the latter.

2. A circuit as claimed in claim 1 in which said means connecting the inductor to the low-level supply includes current control means for controlling the current in the inductor to a predetermined level.

3. A circuit as claimed in claim 2 in which said connecting means includes a transistor having its collector connected to one end of the inductor and its emitter connected by an inductor current sensing resistor to the return rail and means sensitive to the voltage across said resistor controlling the said transistor.

4. A circuit as claimed in claim 2 in which said first switching means is connected to operate as current control controlling the current in the electromagnet independently of the current in the inductor.

* * * * *